US007312563B2

(12) United States Patent
Sawada

(10) Patent No.: US 7,312,563 B2
(45) Date of Patent: Dec. 25, 2007

(54) SHORT ARC LAMP

(75) Inventor: Yasuhiro Sawada, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 183 days.

(21) Appl. No.: 11/199,129

(22) Filed: Aug. 9, 2005

(65) Prior Publication Data

US 2006/0033416 A1 Feb. 16, 2006

(30) Foreign Application Priority Data

Aug. 10, 2004 (JP) ..... 2004-232868

(51) Int. Cl.
*H01J 5/48* (2006.01)
*H01J 5/50* (2006.01)
*H01J 5/54* (2006.01)

(52) U.S. Cl. ..... 313/318.01; 313/623; 313/624; 313/625; 313/632

(58) Field of Classification Search ..... 313/39, 313/46, 238, 318.01, 318.03, 318.11, 326, 313/341, 351, 567, 574, 576, 631, 632, 637, 313/643, 623–625; 362/609
See application file for complete search history.

(56) References Cited

U.S. PATENT DOCUMENTS 3,006,069 A * 10/1961 Rhoads et al. ..... 228/124.1
3,543,076 A * 11/1970 Haslund ..... 313/30
5,479,065 A * 12/1995 Sugimoto et al. ..... 313/113
5,789,863 A 8/1998 Takahashi et al.
6,181,053 B1 1/2001 Roberts
6,281,629 B1 8/2001 Tanaka et al.
2006/0033416 A1* 2/2006 Sawada ..... 313/318.01

FOREIGN PATENT DOCUMENTS

JP 11-162412 A 6/1999
JP 3183145 B2 7/2001

* cited by examiner

*Primary Examiner*—Angela Ortiz
*Assistant Examiner*—Fatima N Farokhrooz
(74) *Attorney, Agent, or Firm*—Rader, Fishman & Grauer PLLC

(57) ABSTRACT

According to the present invention, a short arc lamp comprises a lamp main body having a reflective surface therein, a first opening on an optical axis thereof, and a second openings, a window member provided so as to close the second opening and to define a discharge space between the lamp main body and the opening, a first electrode and a second electrode that are arranged so as to face each other, wherein a tip portion of each of the electrodes extends into the discharge space, and a base disposed approximately at a back end portion of the lamp main body, wherein a hole is formed in the base, the first electrode is held in a burying portion of the base, and a diameter of the first electrode in the burying portion is larger than that of the tip portion of the first electrode.

17 Claims, 3 Drawing Sheets

PRIOR ART

SHORT ARC LAMP

FIELD OF THE INVENTION

The present invention relates to a short arc lamp in which a bulb body that defines an electrical discharge space is made of ceramic, and a reflective surface is formed therein.

DESCRIPTION OF THE RELATED ART

A conventional short arc lamp is disclosed in, for example, Japanese Patent No. 3,183,145, Japanese Laid Open Patent No. 11-162412, or U.S. Pat. No. 6,181,053.

As described in these references, such a short arc lamp is suitably used in the field in which parallel light from a high power point-light source is utilized, such as a projector, and a spectrometer, or in which light from a high power point-light source is condensed on a minute area so as to carry out heating process or illumination by using an optical fiber.

FIG. 3 is an explanatory diagram showing an example of such a short arc lamp, and is a cross-sectional view taken along a plane parallel to an optical axis.

In the figure, a lamp main body 31 is made of an insulating material, more specifically ceramics, such as an alumina, and is approximately cylindrical, in which a concave reflective surface 31*a* is formed. In a light emitting side of the lamp main body, that is, in a front side thereof, a window member 33 for extracting light is inserted and fixed in a frame member 32 which is provided near an end portion of the lamp body 31, and a front opening of the lamp main body 31 is covered by the window member 33 so as to form the electrical discharge space S. In the electrical discharge space S, a pair of electrodes 34 and 35 is provided so as to face each other, along the optical axis of the reflective surface 31*a*.

A base 36 which is made of metal is arranged near a bottom portion of the lamp main body 31, and both the lamp main body 31 and the base 36 are closely brought into contact or fixed to each other by a ring-like fixing member 37 which is arranged on circumferential portions of the lamp main body 31 and the base 36.

In the lamp main body 31 and the base 36, through-holes 31*b* and 36*a* are formed on the optical axis of the reflective surface 31*a*, respectively. The electrode 34 penetrates these holes 31*b* and 36*a*, and a tip portion 34*a* of the electrode 34 extends into the electrical discharge space S. Wax material 38 is filled up between an outer circumferential surface of an end portion 34*b* of the electrode 34 and an inner circumferential surface of the through-hole 36*a*, so that the electrode 34 is electrically and mechanically (physically) connected to the base 36. An annular fixing member 41 which fixes the lamp main body 31 and a flange-like electric supply member 39 is disposed on a front circumferential edge portion of the lamp main body 31. Power is supplied form the outside to the electrode 35 through the flange-like electric supply member 39 and the fixing member 41. Moreover, a conductive support member 40 is connected to the electric supply member 39, and an end portion of the electrode 35 is connected to the support member 40, so that the electrode 35 is supported and disposed in the electrical discharge space S.

In such a short arc lamp, an anode side electric supply terminal (not shown) is connected to the base 36, and on the other hand, a cathode side electric supply terminal (not shown) is connected to the electric supply member 39, so that electric power is supplied.

In such a short arc lamp, electrons which are discharged from the cathode at the time of lighting, are received by the anode, so that the temperature of the anode tends to rise easily.

For this reason, the base portion of the anode also tends to be in a high temperature state. Therefore, for example, in the Japanese Laid Open Patent No. 11-162412, a heat conductive member having heat conductive characteristic, which is better than that of the base material is disposed between the lamp main body and the base, or in the U.S. Pat. No. 6,181,053, radiation fins are disposed around the base, so as not to overheat the lamp.

BRIEF SUMMARY OF THE INVENTION

In such a short arc lamp in which a reflective surface is integrated therein, there is an advantage that a light source apparatus can be miniaturized since it hardly bursts by lighting and it is not necessary to assemble (combine) the lamp and the reflective mirror which are not separated, so that use in the field of compact size medical devices or compact size imaging devices is expected in recent years. In these fields, in order to project an image clearly, increase of light output from a light source is demanded, and on the other hand, it is demanded to lessen space for a light source portion because miniaturization of the apparatus is demanded. Under these circumstances, in such a short arc lamp which is a light source, a lamp input tends to be increased in order to increase a light output, and the lamp body tends to be miniaturized.

For this reason, the temperature of the anode rises more and more, and the wax material 38 which is placed between the anode 34 and the base 36 is overheated so that the material is evaporated or scattered.

Consequently, the interior of the electrical discharge space S is polluted with the substance evaporated from the wax material 38, so that the reflection coefficient of reflective surface 31*a* of the lamp main body 31 falls, the transmittance of the window 33 for extracting light falls, and further the illuminance maintenance rate of the lamp falls at an early stage.

Although in each technology disclosed in Japanese Laid Open Patent No. 11-162412, and U.S. Pat. No. 6,181,053, a function for assisting heat release of the lamp main body is provided, it does not effectively radiate heat from the main body of the anode.

It is difficult to avoid the rapid temperature rise of the anode due to a short time and high lamp input, so that the wax material is overheated thereby resulting in the above-mentioned situation.

In view of the above-mentioned problems, it is an object of the present invention to provide a short arc lamp having a long life span, which is capable of preventing evaporation and scattering of wax material, and controlling fall of lamp illuminance so as to realize a high input, and miniaturization of the lamp.

In the present invention, a short arc lamp comprises a lamp main body having a reflective surface therein, a first opening on an optical axis thereof, and a second openings, a window member provided so as to cover the second opening and to define a discharge space between the lamp main body and the opening, a first electrode and a second electrode that are arranged so as to face each other, wherein a tip portion of each of the electrodes extends into the discharge space; and a base disposed approximately at a back end portion of the lamp main body, wherein a hole is formed in the base, wherein an end portion of a first electrode is inserted in the hole of the base, and penetrates the first opening, wherein wax material is filled in between an inner circumferential surface of the base and a side surface of the first electrode, wherein the first electrode is held in a burying portion of the base, and wherein a diameter of the first electrode in the burying portion is larger than that of the tip portion of the first electrode.

In the short arc lamp, an inner diameter of the first opening that the first electrode penetrates may be smaller than that of a maximum diameter portion of the first electrode in the burying portion.

According to the present invention, since the electrode disposed in a back side of the lamp main body, has, at the base burying portion, a diameter thicker than the maximum diameter of the tip portion extending into the electrical discharge space, an area of an electrode side surface in the burying portion is increased, so that the contact surface between the wax material and the electrode can be increased, and the heat flux per unit area to the wax material decreases, thereby reducing the thermal load to the wax material.

Simultaneously, since the volume of the electrode is increased so that the heat capacity thereof can be increased, it is possible to control the rapid temperature rise of the electrode while the lamp is turned on, and to maintain the electrode to a predetermined temperature or below.

Moreover, since the contact portion of the wax material and the electrode shifts in a radius outside direction with respect to the axis of the anode, it is possible to reduce the attainment temperature of the wax material according to a temperature gradient, thereby reducing the thermal load to the wax material, and therefore, it is possible to control the temperature rise of the wax material, so that it is possible to prevent effectively evaporation and scattering of the wax material.

Since the inner diameter of the opening formed in the reflective surface is smaller than the outer diameter in the burying portion of the anode base, even if the diameter of the anode in the burying portion is large, the area of the reflective surface does not decrease.

Moreover, it is possible to avoid pollution of the interior area of the electrical discharge space since the evaporated substance is hardly scattered in the electrical discharge space even though the wax material is evaporated.

Thus, the present invention possesses a number of advantages or purposes, and there is no requirement that every claim directed to that invention be limited to encompass all of them.

In addition, the foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Description of the present invention be given, referring to Embodiments. While the present invention is not necessarily limited to such embodiments, an appreciation of various aspects of the invention is best gained through a discussion of various examples in such an application.

An embodiment according to the present invention will be explained with reference to FIG. 1.

Figure 1:
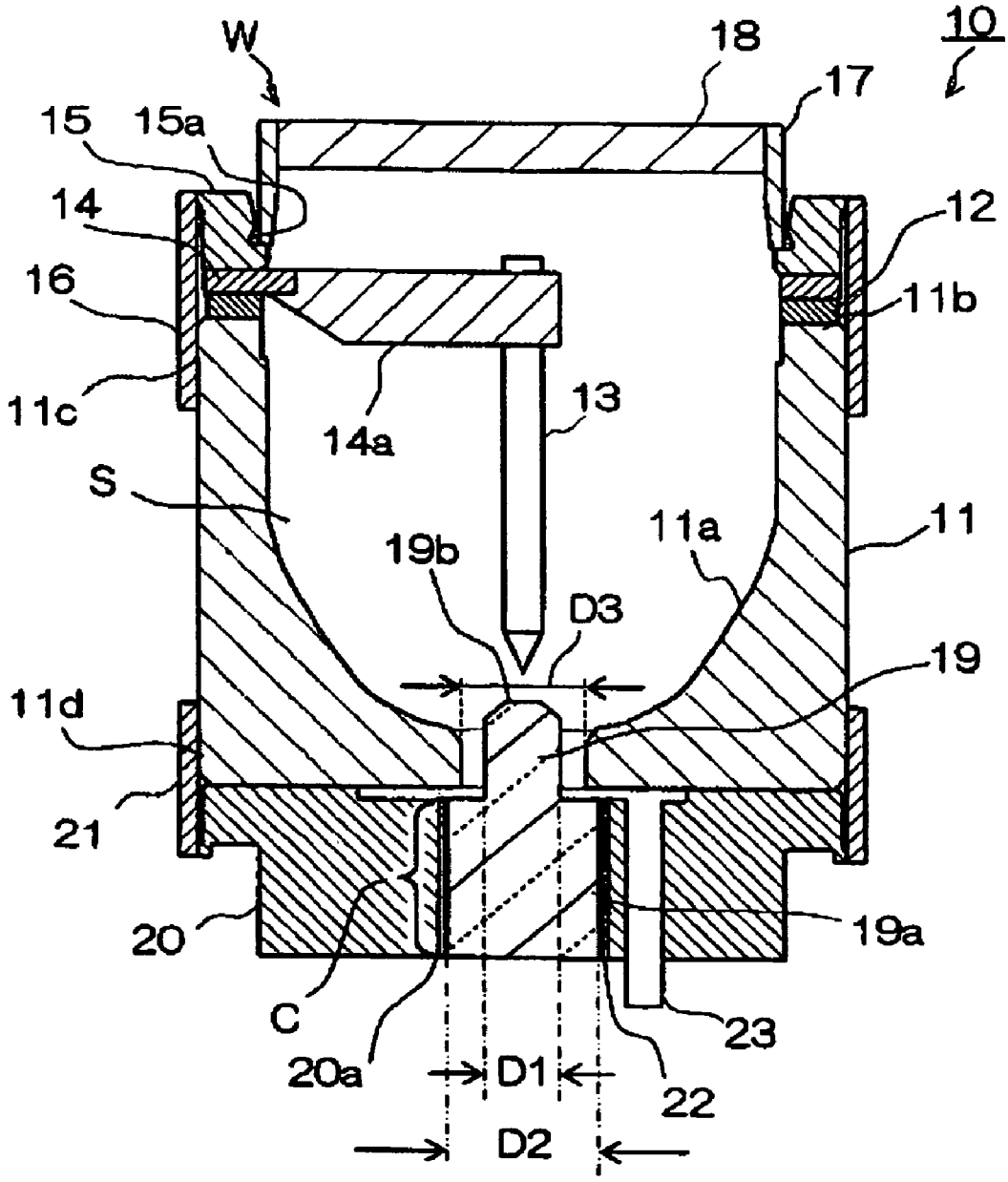
FIG. 1 is a cross-sectional view taken along a plane parallel to the axis of the short arc lamp according to the present invention.

FIG. 1 is a cross-sectional view of a short arc lamp according to the present invention, taken along a plane parallel to an optical axis of the short arc lamp. In the figure, the short arc lamp 10 is equipped with a lamp main body 11 in which a reflective mirror and an electrical discharge space are formed. The lamp main body 11 is made of an insulating material, more specifically ceramics, such as an alumina, and is approximately cylindrical in which a concave reflective surface 11*a* having a curved surface such as an ellipse spherical surface or paraboloid of revolution surface is formed. In a light emitting side of the lamp main body 11, that is, in a front side thereof, a ring-like insulating member 12 made of alumina is disposed along an edge portion 11*b* of the lamp main body 11. A metal support member 14 which is electrically connected to a cathode 13 is disposed on the insulating member 12, and the ring-like electric supply member 15 is arranged on the support member 14. That is, the above-mentioned insulating member 12 secures an insulation distance between the support member 14 of the cathode 13 and the reflective surface 11*a*. And the insulating member 12, the support member 14, and the electric supply member 15 are attached and integrally fixed to the lamp main body by a ring-like first fixing member 16 provided around the edge portion of the lamp main body 11.

An annular groove 15*a* which is convex in a cross-sectional view is formed on an inner surface of the electric supply member 15, and the annular groove 15*a* is engaged with a frame member 17. A window member 18 is inserted in and attached to the frame member 17 so that the window member 18 is attached to the lamp main body 11, thereby forming a window W for extracting light in the short arc lamp. The window member 18 is made of, for example, sapphire which has light transmission characteristic, and proper functions, such as function of decreasing reflection or a function of cutting ultraviolet-rays, are added if needed.

A block shaped base 20 made of metal, for supplying power to an anode 19, is disposed on a bottom surface of the lamp main body 11 which is located on the other side of the window W for extracting light, and is fixed to the lamp main body 11 by an annular second fixing member 21 provided on an outer circumference 11*d* of the lamp main body 11 and the base 20.

A hole 20*a* that an anode 19 can penetrate is formed on the optical axis of the reflective surface 11*a* in the base 20 for electric supply, wherein an end portion 19*a* of the anode 19 is inserted in the hole 20*a*, and wax material 22 is filled in between the base 20 and the anode 19. Thus, the end portion 19*a* of the anode 19 is buried in the base 20, so that both are connected electrically, and at the same time, the anode 19 is supported by the base 20.

A tip portion 19*b* of the anode 19 is projected in a space surrounded by the inner surface of the reflective surface 11*a* in the lamp main body 11, so as to extend in the electrical discharge space S. The cathode 13 is supported in the space by a supporting portion 14*a* of the support member 14 so as to face the anode 19. The positions of the cathode 13 and the anode 19 are determined by the position of the focal point of the reflective surface 11*b* in the lamp main body 11, wherein each of axes thereof is usually set so as to agree with the optical axis of the reflective surface 11*b*.

In addition, in the lamp main body 11, Mo—Mn metallizing processing is carried out to surfaces 11*c* and 11*d* corresponding to portions where the first and second fixing members 16 and 21 are provided, wherein the first and second fixing members 16 and 21 are fixed to respective surfaces 11*c* and 11*d* by soldering so that they are fixed airtightly. Moreover, the electric supply member 15 and the frame member 17, or the frame member 17 and the window member 18 are joined airtightly by welding or soldering so that the electrical discharge space S is sealed.

In addition, in this electrical discharge space S, xenon gas is filled in and enclosed as discharge gas through an exhaust pipe 23 provided in the base 20. In addition, as shown in the figure, the exhaust pipe 23 remains after the electrical discharge space S is sealed.

In the above structure according to the present invention, in the burying portion C where the anode 19 is buried in the base 20, the anode 19 has the diameter which is larger than that of the tip portion 19*b* extending into the discharge space S. Specifically, a diameter D2 of a maximum diameter portion in the burying portion C is larger than a diameter D1 of a maximum diameter portion of the tip portion 19*b* of the electrode. Therefore, as compared with the conventional short arc lamp in which the diameter of the anode in the burying portion C is the same as that of the tip portion 19*b*, since in the present invention, the diameter of the anode 19 in the burying portion C has a larger diameter, a surface area is expanded in the burying area C in fact, so that the contact surface between the wax material 22 and the electrode 19 is expanded, and the heat flux per unit area to the wax material can be decreased, thereby reducing the thermal load to the wax material.

Furthermore, since in almost all the area of the burying portion C, the anode has a diameter which is larger than that of the tip portion 19*b*, the volume of the anode 19 is increased without changing the diameter of the tip portion 19*b* of the anode 19. That is, the heat capacity can become large, and the rapid temperature rise of the anode 19 during lighting of the lamp can be controlled, and the anode 19 can be maintained to a predetermined temperature or below. Moreover, since the wax material 22 shifts in a radius outside direction with respect to the axis of the anode 19, it is possible to reduce the attainment temperature of the wax material 22 according to a temperature gradient, thereby reducing the thermal load to the wax material 22. Consequently, since it is possible to prevent temperature rise of the wax material 22 thereby preventing evaporation thereof beforehand, it is possible to effectively prevent the interior of the electrical discharge space D from being polluted by scattering of the substance evaporated from the wax material 22.

Moreover, if, as in the present embodiment, the inner diameter D3 of the opening which is formed in the reflective surface 11*a* in order to insert the anode 19, is made smaller than the diameter D2 of the end portion 19*a* (the burying portion C), it is possible to form the reflective surface 11*a* without reducing the area of the reflective surface 11*a*, as compared with the conventional short arc lamp, and radiation light is effectively used without optical loss due to the reduction of the area of the reflective surface. Moreover, in the structure as shown in the figure, even if the wax material 22 is evaporated, since the wax material 22 does not face the reflective surface 11*a* or the window member 18, substance evaporated from the wax material 22 stays between the lamp main body 11 and the electric supply member 20 so that it is hardly scattered in the electrical discharge space, thereby preventing pollution of inside of the electrical discharge space.

As mentioned above, in the short arc lamp according to a present invention, the surface area of the anode in the burying portion is increased, so that the contact surface between the wax material and the anode can be increased, and the heat flux per unit area to the wax material decreases, thereby reducing the thermal load to the wax material.

Consequently, the temperature rise of the wax material 22 is controlled, so that evaporation and scattering can be prevented effectively, and it becomes possible to maintain high illuminance maintenance rate of the short arc lamp. This effect will be attained if part of the burying portion has a diameter larger than the diameter of the maximum diameter portion of the tip portion.

Furthermore, since the diameter of almost all the electrode area which is located in the burying portion is larger than the diameter of the maximum diameter portion of the tip portion, the volume of the electrode can be made large so that heat capacity can be increased, thereby controlling the rapid temperature rise of the electrode while the lamp is turned on, and further, it is possible to maintain the electrode to a predetermined temperature or below. Moreover, since the contact portion of the wax material and the electrode shifts in a radius diameter outside direction with respect to the axis of the anode, it is possible to reduce the attainment temperature of wax material according to a temperature gradient. Furthermore, temperature rise is controlled so that it is possible to effectively prevent evaporation of the wax material and scattering of substance evaporated from the wax material.

Although the embodiments of the present invention are explained above, the present invention is not limited to the above-mentioned embodiments, and various modifications to each part of the structure can be made.

Figure 2A:
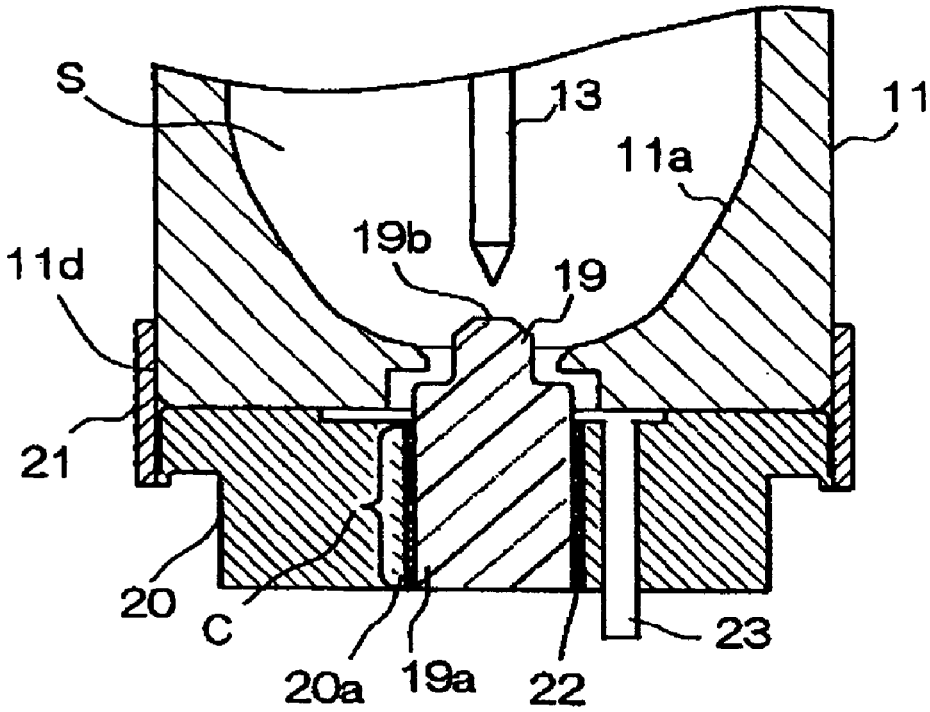
FIGS. 2A and 2B are enlarged cross-sectional views of a short arc lamp according to other embodiments of the present invention.
Figure 2B:
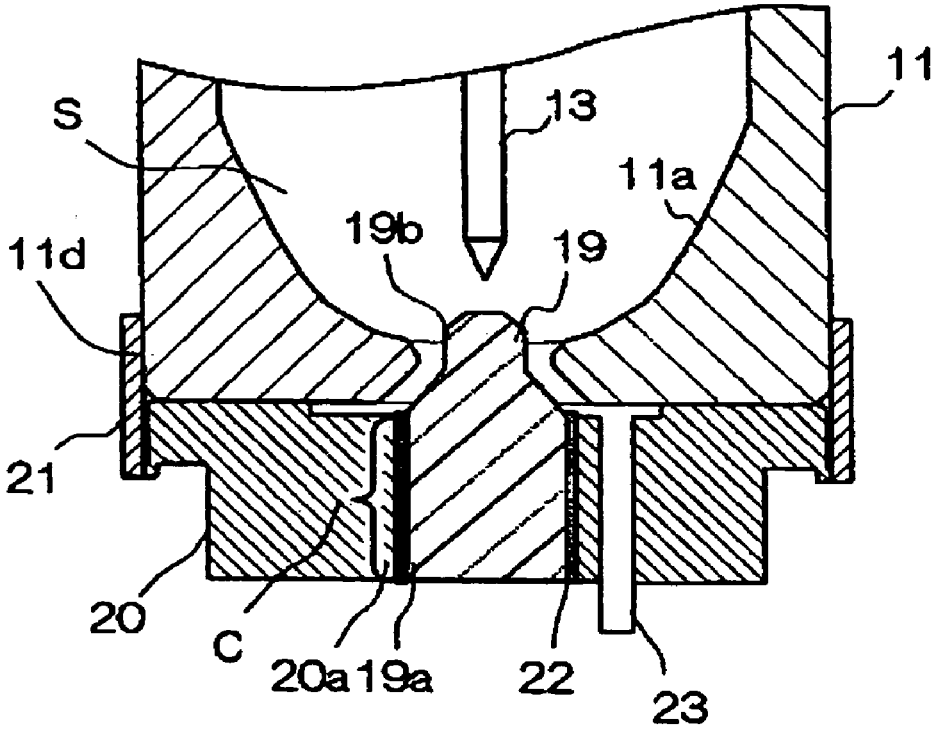
Figure 3:
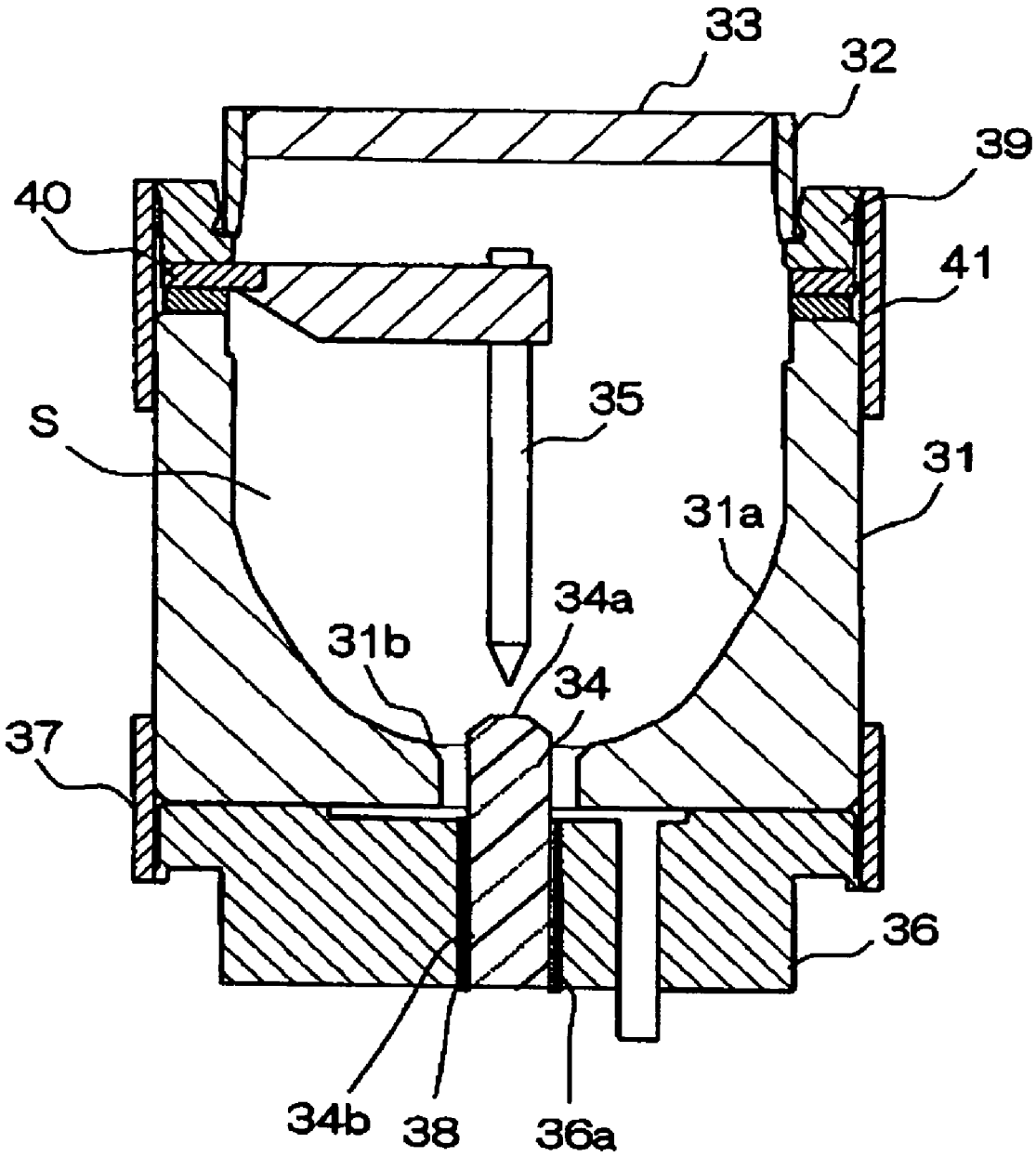
FIG. 3 is a cross-sectional view of an example of a conventional short arc lamp, taken along a plane parallel to the optical axis.

FIGS. 2A and 2B are enlarged cross-sectional views of a short arc lamp according to another embodiment. In addition, in these figures, the same reference numbers are used for the same elements as those shown in FIG. 1, and explanation thereof is omitted.

FIG. 2A shows an example of the short arc lamp in which a portion of the anode, which is located between the tip portion of the anode and the burying portion, has approximately the same diameter as the burying portion of the anode so as to increase the volume of the anode. In this case, a step-like recess portion is formed in an inner direction on a back end surface of the lamp main body so that the same diameter portion of the anode is accommodated therein, as shown in the figure. Moreover, In FIG. 2B, the above-mentioned portion, which is located between the tip portion and the burying portion of the anode, has approximately the same diameter as the burying portion, and is tapered toward the tip portion.

According to the above embodiments, since the volume of the anode increases, heat capacity becomes still larger, so that the rapid temperature rise of the anode can be prevented, and evaporation of the wax material can be avoided.

Based on the structure shown in FIG. 1, ten short arc lamps according to the present invention were produced in total according to the conditions set forth below.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A short arc lamp comprising:

a lamp main body having a reflective surface therein, a first opening on an optical axis thereof, and a second openings;

a window member provided so as to cover the second opening and to define a discharge space between the lamp main body and the opening;

a first electrode and a second electrode that are arranged so as to face each other, wherein a tip portion of each of the electrodes extends into the discharge space; and a base disposed approximately at a back end portion of the lamp main body, wherein a hole is formed in the base, wherein an end portion of a first electrode is inserted in the hole of the base, and penetrates the first opening, wherein wax material is filled in between an inner circumferential surface of the base and a side surface of the first electrode, wherein the first electrode is held in a burying portion of the base, and wherein a diameter of the first electrode in the burying portion is larger than that of the tip portion of the first electrode, and an inner diameter of the first opening that the first electrode penetrates is smaller than that of a maximum diameter portion of the first electrode in the burying portion.

2. The short arc lamp according to claim 1, wherein a middle portion of the first electrode, which is located between the tip portion of the first electrode and the burying portion, has approximately the same diameter as the burying portion of the first electrode, and a recess portion is formed in an inner direction on a back end surface of the lamp main body so that the middle portion of the first electrode is accommodated therein.

3. The short arc lamp according to claim 2, wherein the middle portion and the recess portion are tapered.

4. The short arc lamp according to claim 1, wherein the lamp main body is made of an insulating material.

5. The short arc lamp according to claim 4, wherein the insulating material is ceramic.

6. The short arc lamp according to claim 5, wherein the ceramic is alumina.

7. The short arc lamp according to claim 1, further including an insulating member disposed along an edge portion of the lamp main body.

8. The short arc lamp according to claim 7, further including a supporting member which is electrically connected to the second electrode and disposed on the insulating member.

9. The short arc lamp according to claim 8, further including an electric supply member arranged on the support member.

10. The short arc lamp according to claim 9, further including a first fixing member that fixes the insulating member, the support member, and the electric supply member to the lamp main body.

11. The short arc lamp according to claim 10, further including a frame member.

12. The short arc lamp according to claim 11, wherein an annular groove is formed on an inner surface of the electric supply member and is engaged with the frame member.

13. The short arc lamp according to claim 1, wherein the window member is made of sapphire.

14. The short arc lamp according to claim 1, wherein the base is made of metal in order to supply power to the first electrode.

15. The short arc lamp according to claim 1, further including a second fixing member that fixes the lamp main body and the base.

16. The short arc lamp according to claim 15, wherein Mo—Mn metallizing processing is carried out to surfaces where the first and second fixing members are provided, so that the first and second fixing members are fixed to respective surfaces by soldering.

17. The short arc lamp according to claim 1, wherein xenon gas is filled in and enclosed as discharge gas through an exhaust pipe.

* * * * *